United States Patent [19]

Summers

[11] 4,261,478

[45] Apr. 14, 1981

[54] TAMPER-PROOF CLOSURE CAP

[75] Inventor: Kenneth L. Summers, Angola, Ind.

[73] Assignee: Ruke Corporation, Auburn, Ind.

[21] Appl. No.: 83,382

[22] Filed: Oct. 10, 1979

[51] Int. Cl.[3] ..... B65D 41/32

[52] U.S. Cl. ..... 220/270; 220/214; 215/216; 215/252; 215/256

[58] Field of Search ..... 220/214, 270, 266; 215/256, 252, 216; 222/541, 153

[56] References Cited

U.S. PATENT DOCUMENTS

| | | | |
|---|---|---|---|
| 3,812,994 | 5/1974 | Feldman | 215/256 |
| 3,891,110 | 6/1975 | Gach | 215/216 |

FOREIGN PATENT DOCUMENTS

| | | | |
|---|---|---|---|
| 2548132 | 5/1977 | Fed. Rep. of Germany | 220/214 |

*Primary Examiner*—George T. Hall

[57] ABSTRACT

A tamper-proof closure cap for use with the externally threaded neck opening of a container for providing a visible indication of tampering attempts with the container includes a generally cylindrical main body portion which is internally threaded and suitable for mating engagement with the externally threaded neck opening. Extending around the lower edge of the main body portion and for approximately 150° is a removable sector ring which is joined to the main body portion by three evenly spaced-apart connecting elements. Located adjacent to the externally threaded neck opening is an interlock protuberance which includes an inclined lower surface and the top surface of the removable sector ring has a compatible sawtooth profile. The teeth of the sawtooth profile ratchetly engage the inclined surface of the interlock protuberance. The pitch of the internal and external threads is such so as to dispose the removable sector ring above the interlock protuberance on all revolutions of the closure cap onto the neck opening prior to the last turn. After the last turn the removable sector ring is disposed beneath the interlock protuberance and ratchetly engages its inclined lower surface. Due to the wedge-shaped teeth, the closure cap is unable to be unscrewed from the neck opening until such time as the sector ring is separated from the main body portion which may be accomplished by pulling on the sector ring and fracturing the three connecting elements.

14 Claims, 8 Drawing Figures

TAMPER-PROOF CLOSURE CAP

BACKGROUND OF THE INVENTION

This invention relates in general to container closure caps and in particular to such styles of caps which include tamper-proof or tamper-indicating features.

During the marketing of various industrial and consumer items, the container in which materials, primarily fluids and liquids, are shipped may be subject to being opened and tampered with during shipment and such tampering may go unnoticed. With perishable materials this may result in spoiled contents at the retail outlet. With chemicals, contamination may result in making the chemicals unuseable. In order to minimize such tampering or at the very least to provide an indication of whether or not such tampering was attempted, a number of container styles have incorporated therewith tamper-proof means or tamper-indicating means. Such tamper-related means are intended to clearly indicate whether or not any individual gained access to the contents of the particular container.

One very common example of such a tamper proof-closure concept is found on plastic containers of milk. Another similar type of device can be found on cola and soft-drink containers which incorporate a metal cap and perforated therewith a retaining ring. In the event the interface between the cap and retaining ring is broken, it becomes very evident that one may have gained access to the container and consequently the consumer is forewarned of a potential problem. Such cap and closure concepts are not limited solely to the food industry but have similar applicability to the chemical processing industry and other similarly related areas where materials are shipped in containers.

Although such tamper-proof closure concepts are often molded, a variety of manufacturing techniques are available, yet regardless of the material or manufacturing process employed, the aspects of part cost, complexity and user acceptance remain relevant. If the design of the tamper-proof closure cap is such that it necessitates a relatively complex mold and a resultant complex part, the cost alone may force potential users to switch to another design. Another factor involves the nature of the container and cap, their reusability and the physical appearance of the container once the tamper-proof closure is defeated by the user.

The following listed patents each relate to closure cap concepts for containers wherein some type of tamper-proof indicating means is provided.

| Patent No. | Patentee |
|---|---|
| 2,162,712 | Hamberger |
| 2,162,754 | Schauer |
| 2,172,159 | Conner et al. |
| 3,352,448 | Livingstone |
| 3,441,161 | Van Baarn |
| 3,493,140 | MacNeill |
| 3,650,428 | Miller |
| 3,812,994 | Feldman |

Hamberger discloses a container and closure combination wherein the container outlet opening is provided with a plurality of lugs and the cap includes a lower removable skirt portion arranged to interlock with the lugs.

Schauer discloses a tamper-proof closure cap and container combination very similar to Hamberger with the exception that in one embodiment, the skirt portion which interlocks beneath the lugs is a separate component part from the resealable cap.

Conner et al. discloses container closure means of the type having a readily breakable portion which is necessarily broken when the closure means or one member thereof is removed to permit access through or discharge contents from the container. Although the cap itself has a removable lower skirt portion, there is also included a metal breaking device which must be first put into place on the mouth of the bottle.

Livingstone discloses a resilient closure concept which is designed to be attached by mere pressure to the flaring annular wall which surrounds an opening in a container.

Van Baarn discloses a bottle cap concept which includes an upper and lower pair of body sections hinged together and initially joined by a rupturable security seal. The bottle cap further includes a hand grip in a protective position relative to the rupturable security seal.

MacNeill discloses a tamper-proof closure arrangement for a container and related cap and includes a locking ring interposed therebetween and adapted to break apart when the cap is first loosened after it has been initially applied to the container.

Miller discloses a tamper-proof closure device for application to external threaded convolusions of a container. Ratchet teeth provided along the inner surface of a locking ring are adapted to interlock with complementary external teeth or protuberances on the container.

Feldman discloses a closure cap for the neck of a bottle or other container and includes a cap body having internal thread means designed to engage external threads on the neck and a ratchet ring connected to the body by means of a shoulder.

While each of these various devices represent a somewhat similar arrangement by their use of a removable skirt portion and some type of interlocking surface contour, such as ratchet teeth, these various designs still present certain disadvantages. For those designs which include a full circumference for the removable skirt portion or ring, the cost of the cap is greater due to additional material and mold complexity than would be the case with only a partial skirt portion or ring. With those designs which incorporate lugs or ratchet teeth as part of the raised container opening, the cost of the container due to the increased complexity is greater than if a conventional raised opening is utilized. A further disadvantage with many of the designs of the listed patents involves the opportunity to pry up on the ring or skirt portion or in some way warp its contour so as to allow certain edges to be separated from their interlocking members. Still other cap designs disclosed by these various patents are a disadvantage because they incorporate two separate component pieces to accomplish what can be achieved by a single component piece. The effects of this are realized by the inventory ordering and storing of parts. Those designs which include a retaining ring which separates from the resealable cap portion are not able to be reused by merely adding a new cap. The machine requirements to install a new retaining ring preclude the user in the field from being able to reseal the container in a tamper-proof manner for further shipment or storage.

A consideration of these various disadvantages by the applicant has resulted in the present invention which incorporates only a partial interlocking ring which fits beneath an interlocking tab remote from the container opening such that the ring cannot be pryed upwardly on and the container opening is a standard externally threaded opening. By using a standard threaded opening, containers can be mass-produced without the remote interlocking tab. If a tamper-proof arrangement is desired, this interlocking tab can be added later. These and other related improvements and advantages will be apparent from the descriptions which follow.

SUMMARY OF THE INVENTION

A tamper-proof closure cap for use with the neck opening of a container for providing a visible indication of attempts to tamper with the container according to one embodiment of the present invention comprises a generally cylindrical main body portion suitably designed and constructed to fit over said neck opening for sealing said neck opening closed, a removable sector ring joined to the exterior of said generally cylindrical main body portion and circumferentially extending around said main body portion a distance less than 360° and means for joining said removable sector ring to said generally cylindrical main body portion, said joining means being fracturable for separation of said removable sector ring from said generally cylindrical main body portion.

DESCRIPTION OF THE PREFERRED EMBODIMENT

Figure 1:
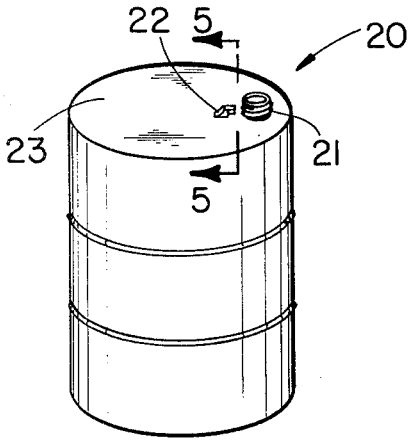
FIG. 1 is a perspective view of a container including a raised outlet and remote interlocking tab.

For the purposes of promoting an understanding of the principles of the invention, reference will now be made to the embodiment illustrated in the drawings and specific language will be used to describe the same. It will nevertheless be understood that no limitation of the scope of the invention is thereby intended, such alterations and further modifications in the illustrated device, and such further applications of the principles of the invention as illustrated therein being contemplated as would normally occur to one skilled in the art to which the invention relates.

Referring to FIG. 1, there is illustrated a container 20 which includes a raised outlet opening 21 and in spaced relation thereto an interlocking protuberance or tab 22. Outlet opening 21 is externally threaded and extends upwardly from top surface 23 a distance of approximately 0.62 inches. Interlock tab 22 is joined to top surface 23 and its location is governed by the location of opening 21 and the threads of the opening. Although both outlet opening 21 and interlock tab 22 are preferably molded as part of top surface 23, which may be separately joined to the remainder of container 20, it is also possible and in some cases desirable to attach raised outlet opening 21 and interlock tab 22 separately by any number of various joining and attaching methods. One advantage with the present design is that interlock tab may be added, or not added as the user elects, to a standard container having an outlet such as outlet opening 21. If it is desired to use the tamper-proof closure cap of the present invention with such a container, then interlock tab 22 is provided. Otherwise, tab 22 may be omitted. This variable feature results in greater versatility for standard containers as well as an adaptability of the subject invention to existing containers.

Figure 1A:
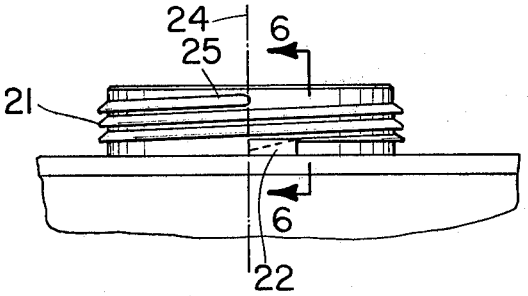
FIG. 1A is a partial, front elevation view of the FIG. 1 container.
Figure 6:
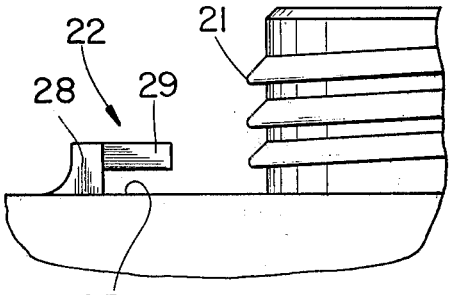
FIG. 6 is a side elevation view of the FIG. 1 interlock tab as viewed along line 6—6 in FIG. 1A.
Figure 5:
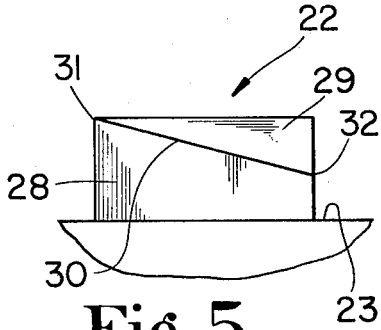
FIG. 5 is a rear elevation view of the FIG. 1 interlocking tab as viewed along line 5—5 in FIG. 1.

There is a particular relationship between the thread location of outlet opening 21 and the placement of interlock tab 22 and this is illustrated in FIG. 1A wherin line 24 indicates both the beginning of threads 25 and the edge of interlock tab 22. FIG. 1A also suggests the height relationship between outlet opening 21 and interlock tab 22. FIGS. 5 and 6 complete the description of interlock tab 22 and it should be understood from the combination of figures that interlock tab 22 is somewhat L-shaped including a base portion 28 and an overhanging portion 29. Overhanging portion 29 is wedge-shaped having an incline surface 30 which tapers downwardly from top edge 31 to lower edge 32. The angle of taper of incline surface 30 is approximately 14 degrees and there is a slight region of separation between lower edge 32 and top surface 23 and the height dimension of this region of separation is less than 0.10 inches.

Figure 2:
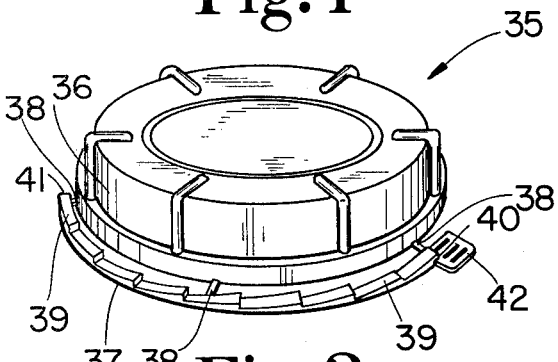
FIG. 2 is a perspective view of a tamper-proof closure cap for use with the FIG. 1 container according to a typical embodiment of the present invention.
Figure 3:
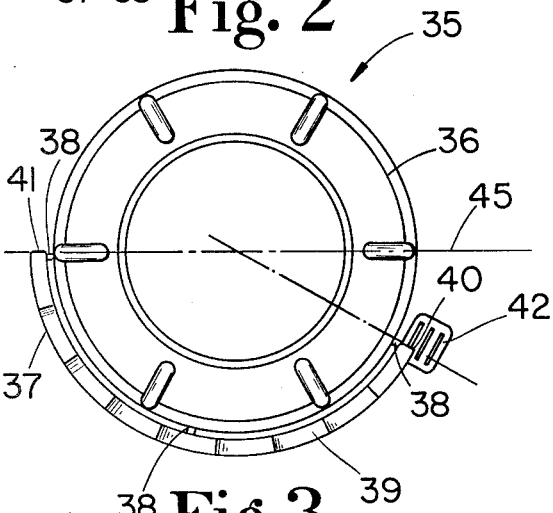
FIG. 3 is a top plan view of the FIG. 2 tamper-proof closure cap.

Referring to FIGS. 2 and 3, a tamper-proof closure cap 35 is illustrated and the design of this particular cap is suitable for use with the outlet opening 21 and interlock tab 22 of container 20. Tamper-proof closure cap 35 includes a generally cylindrical main body portion 36, a removable sector ring 37 and an evenly spaced series of three connecting members 38 joining removable sector ring 37 to main body portion 36. Removable sector ring 37 includes a plurality of ratchet teeth 39 extending from first end 40 to second end 41 and first end 40 is provided with a pull tab 42 which is suitable for gripping between the thumb and index finger for separating the sector ring 37 from the main body portion 36. Pull tab 42 may also be gripped by a tool such as a pair of pliers, but this is not necessary for removal. Removable sector ring 37 extends circumferentially around main body portion 36 for a distance of approximately 150 degrees which is in part diagrammatically represented in FIG. 3 by the positions of first end 40 and second end 41 with respect to diameter line 45. The fact that removable sector ring 37 circumferentially extends for a distance less than 360° is an important aspect in the overall construction and use of tamper-proof closure cap 35 and this particular aspect will be explained in greater detail hereinafter.

Figure 7:
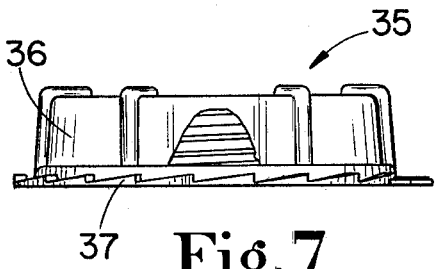
FIG. 7 is a fragmentary front elevation view of the FIG. 2 tamper-proof closure cap.

Generally cylindrical main body portion 36 is internally threaded (see FIG. 7) and the threads of main body portion 36 have a compatible size and pitch with threads 25 such that closure cap 35 may be downwardly (axially) advanced onto outlet opening 21 as closure cap 35 is turned in a clockwise direction. This represents a conventional internally-threaded cap and externally threaded opening closure concept. One aspect which is important to recognize is that inclined surface 30 of interlock tab 22 tapers downwardly in this clockwise direction. Correspondingly, the teeth 39 disposed on the top surface of sector ring 37 taper rearwardly and upwardly relative to the clockwise turning direction and advancement of closure cap 35 onto outlet opening 21.

Due to the positional relationships between the internal threads and the external threads, and the dimensions of outlet opening 21 and closure cap 35, as closure cap 35 is placed on top of outlet opening 21 and clockwise turning is initiated, removable sector ring 37 is positioned above interlock tab 22. With each turn of closure cap 35, removable sector ring 37 is drawn closer and closer to the top surface of interlock tab 22. If removable sector ring 37 extended completely around main body portion 36, then there would be virtually no way for the ring to orient itself beneath overhanging portion 29 of interlock tab 22 for ratchet engagement of the complementary teeth. However, inasmuch as removable sector ring extends for only approximately 150° around the circumference of main body portion 36, on the next-to-last turn of closure cap 35, before full sealing is achieved, removable sector ring 37 passes just over the top surface of interlock tab 22. Thereafter, on the subsequent revolution as second end 41, which is the leading edge of removable sector ring 37 during cap advancement, comes around toward interlock tab 22, the pitch of the internal and external threads of the closure cap and outlet opening, respectively, have lowered the position of removable sector ring 37 relative to interlock tab 22 and top surface 23 such that removable sector ring 37 passes beneath overhanging portion 29. The sector ring passes above the interlock tab on all turns of the cap onto the opening, prior to the last turn which results in full seating of the cap. Both the internal and external threads have a pitch of approximately eight threads per inch and this pitch results in an axial (downward) advancement of the cap onto the neck opening at a rate of approximately 0.12 inches per revolution.

Inasmuch as the clearance between lower edge 32 and top surface 23 is less than the maximum tooth thickness of the removable sector ring, there is a moderate amount of interference as the teeth contact and this is accommodated by slight upward flexing of overhanging portion 29. Initially as sector ring 37 contacts the inclined surface 30 of overhanging portion 29, the ratchet-tooth-to-ratchet-tooth interference will be more pronounced, but as closure cap 35 continues to downwardly advance on outlet opening 21, this interference lessens. However, even in the cap-fully-seated condition, there is still a moderate degree of interference thereby providing the tamper-proof nature of the present invention.

Figure 4:
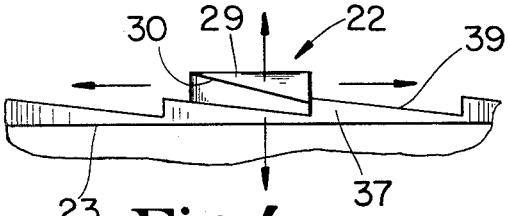
FIG. 4 is a partial front elevation view of the interlocking engagement between the FIG. 2 closure cap and the FIG. 1 interlocking tab.

The tapered contour of each tooth 39 is compatible with inclined surface 30 so as to result in a ratchet engagement which is diagrammatically illustrated in FIG. 4. As removable sector ring 37 continues to be turned (horizontal arrows), the twisting action of closure cap onto outlet opening 21 results in force vectors tending to push the ring and inclined surface apart (vertical arrows) thereby permitting continued advancement of the cap. It can be seen from the FIG. 4 illustration that once removable sector ring 37 is disposed beneath overhanging portion 29, reverse turning (attempting to unscrew closure cap 35 from outlet opening 21) is not possible. Again, due to the pitch of the internal and external threads, closure cap 35 becomes completely seated onto top surface 23 around outlet opening 21 before first end 40 reaches interlock tab 22.

The result achieved relies on the location of the beginning portion of threads 25 relative to interlock tab 22 and the placement of removable sector ring 37 around closure cap 35 relative to the internal threads of main body portion 36. However, once these various relationships are established, the closure cap merely threads onto outlet opening 21 in a conventional manner and removable sector ring will be automatically brought into position with ratcheted interlocking engagement with interlock tab 22. No other action is required of the user except to fully thread the cap onto the opening. Once closure cap 35 is completely seated (sealed) onto outlet opening 21, no loosening or removal is possible until such time as sector ring 37 is removed. Removal of sector ring is achieved by pulling on pull tab 42 and separating connecting members 38 from main body 36. Alternatively, a thin tearable diaphragm could be used between sector ring 37 and main body portion 36, the importance of the concept being that some means are provided to hold the two component parts together yet allow the parts to be separated under a suitable, though moderate, pulling force. The connecting members 38 may be of uniform cross-sectional shape throughout their entire length or, alternatively, may be slightly tapered or notched at their point of connection to main body portion 36. By a selective reduction in thickness or diameter at a particular point it is possible to control at what location connecting members 38 separate from the two component parts. It is desirable to have the connecting members break away from the main body portion rather from the ring so that the resultant edge of main body portion is smooth and does not present outwardly extending protuberances. The result is that closure cap and container combination appear conventional in all regards except for the remaining presence of interlock tab 22.

The advantage of this structure is that interlock tab 22 can be reused time and time again by merely the replacement of a new closure cap and removable sector ring combination. This allows partial use of container contents and the option of resealing the container in a tamper-proof manner. It should also be understood that regardless of how often a cap, whether the same one or a replacement, is applied to the neck opening, the starting point is the same and consequently so is the ending point. This assures proper ring orientation relative to the remaining structure. With those prior art devices that include a lower skirt portion which is separated from the resealable cap portion, this lower skirt portion remains on the container and does not really provide a reusable structure. In the exemplary embodiment, removable sector ring 37 includes nine ratchet teeth 39, each of which are approximately one-half inch in length and the bottom edge of sector ring 37 is substantially flush with the bottom edge of main body portion 36. It is also preferred that the entire closure cap be of a molded construction from a material composition such as polyethylene. However, the concepts of the present invention are equally applicable to a variety of thermosetting and thermoforming compounds so long as a moderate degree of flexibility as well as rigidity are provided.

While the invention has been illustrated and described in detail in the drawings and foregoing description, the same is to be considered as illustrative and not restrictive in character, it being understood that only the preferred embodiment has been shown and described and that all changes and modifications that come within the spirit of the invention are desired to be protected.

What is claimed is:

1. A tamper-proof closure cap for use with a neck opening of a container for providing a visible indication of attempts to tamper with said container, said tamper-proof closure cap comprising:

a generally cylindrical main body portion having a substantially flat bottom surface and being suitably designed and constructed to fit over said neck opening for sealing said neck opening closed;

a removable sector ring member having a top surface with a generally sawtooth profile and an opposite bottom surface and being joined to the exterior of said generally cylindrical main body portion and circumferentially extending around said generally cylindrical main body portion a distance less than 360 degrees, the bottom surface of said removable sector ring member being substantially flush with the bottom surface of said generally cylindrical main body portion; and means for joining said removable sector ring member to said generally cylindrical main body portion, said joining means being fracturable for separation of said removable sector ring member from said generally cylindrical main body portion.

2. The tamper-proof closure cap of claim 1 wherein said joining means includes three spaced apart connecting elements extending between said removable sector ring member and said generally cylindrical main body portion.

3. The tamper-proof closure cap of claim 1 wherein said generally cylindrical main body portion is internally threaded and said neck opening is externally threaded with corresponding engageable mating theads.

4. The tamper-proof closure cap of claim 1 wherein said removable sector ring member is joined to said generally cylindrical main body portion by three connecting elements and said removable sector ring member circumferentially extends for at least 90 degrees.

5. The tamper-proof closure cap of claim 3 wherein the pitch of said internal and external threads is such so as to result in the axial advancement of said generally cylindrical main body portion at a rate of between 0.10 and 0.26 inches per revolution.

6. The tamper-proof closure cap of claim 5 wherein said removable sector ring member is positioned with respect to the beginning of said internal threads such that the axial height of said removable sector ring member with respect to the neck opening relative to movement around said neck opening with threaded advancement of said cap is substantially the same with each application of the cap onto the neck opening.

7. The tamper-proof closure cap of claim 6 wherein each tooth of said generally sawtooth profile having an inclined top surface which extends downwardly from a top edge to a bottom edge and wherein said sawtooth profile is engageable during cap advancement with a compatibly sized and shaped interlock protuberance of said container, said interlock protuberance preventing unscrewing of said closure cap from said neck opening after engagement.

8. The tamper-proof closure cap of claim 7 wherein said removable sector ring member is sized and arranged relative to said main body portion and said neck opening so as to be disposed above said interlock protuberance prior to beginning the last revolution of said closure cap on said neck opening and below said interlock protuberance when said closure cap is fully seated onto said neck opening.

9. In combination:

a container having a raised, externally threaded neck opening and an interlock protuberance in spaced relation therewith, said interlock protuberance including a wedge-shaped portion; and a tamper-proof closure cap for use with the neck opening for providing an indication of attempts to tamper with said container, said tamper-proof closure cap comprising:

a generally cylindrical main body portion suitably designed and constructed to fit over said neck opening for sealing said neck opening closed;

a removable sector ring member having a top surface with a generally sawtooth profile and being joined to the exterior of said generally cylindrical main body portion and circumferentially extending around said generally cylindrical main body portion a distance less than 360 degrees, said sawtooth profile being suitably sized and arranged to ratchetly engage said wedge-shaped portion; and means for joining said removable sector ring member to said generally cylindrical main body portion, said joining means being fracturable for separation of said removable sector ring member from said generally cylindrical main body portion.

10. The combination of claim 9 wherein said generally cylindrical main body portion is internally threaded and said neck opening is externally threaded with engageable mating threads, the pitch of said engageable mating threads being such so as to result in the axial advancement of said generally cylindrical main body portion at a rate of between 0.10 and 0.26 inches per revolution.

11. The combination of claim 10 wherein said removable sector ring member is sized and arranged relative to said main body portion and said neck opening so as to be disposed above said interlock protuberance prior to the final revolution of said cap onto said neck opening and below said interlock protuberance once said closure cap is fully seated onto said neck opening.

12. In combination:

a container having a raised, externally threaded neck opening and an interlock protuberance in spaced relation therewith; and a tamper-proof closure cap for use with the neck opening for providing an indication of attempts to tamper with said container, said tamper-proof closure cap comprising:

a generally cylindrical main body portion suitably designed and constructed to fit over said neck opening for sealing said neck opening closed;

a removable sector ring member having a top surface with a generally sawtooth profile and being joined to the exterior of said generally cylindrical main body portion and circumferentially extending around said generally cylindrical main body portion a distance less than 360 degrees; and means for joining said removable sector ring member to said generally cylindrical main body portion, said joining means being fracturable for separation of said removable sector ring member from said generally cylindrical main body portion.

13. The combination of claim 12 wherein said joining means includes three spaced-apart connecting elements.

14. The combination of claim 13 wherein said removable sector ring member is positioned with respect to the beginning end of said internal threads such that the axial height of said removable sector ring member with respect to said neck opening relative to movement around said neck opening with threaded advancement of said closure cap is substantially the same with each application of the cap onto the neck opening.

* * * * *

UNITED STATES PATENT AND TRADEMARK OFFICE

CERTIFICATE OF CORRECTION

PATENT NO. : 4,261,478

DATED : April 14, 1981

INVENTOR(S) : Kenneth L. Summers

It is certified that error appears in the above-identified patent and that said Letters Patent are hereby corrected as shown below:

Change the spelling of the name of the Assignee from "Ruke" Corporation to --Rieke-- Corporation.

Signed and Sealed this

*Thirtieth* Day of *June 1981*

[SEAL]

*Attest:*

RENE D. TEGTMEYER

*Attesting Officer*

*Acting Commissioner of Patents and Trademarks*